United States Patent [19]

Weiler et al.

[11] 4,226,334

[45] Oct. 7, 1980

[54] STOPPER

[75] Inventors: Gerhard H. Weiler, South Barrington; Dieter H. Nagel, Des Plaines, both of Ill.

[73] Assignee: Automatic Liquid Packaging, Inc., Arlington Heights, Ill.

[21] Appl. No.: 969,184

[22] Filed: Dec. 14, 1978

[51] Int. Cl.[2] ..... B65D 39/00

[52] U.S. Cl. ..... 215/355; 215/247; 150/0.5

[58] Field of Search ..... 215/247, 355; 150/0.5

[56] References Cited

U.S. PATENT DOCUMENTS

| | | | |
|---|---|---|---|
| 702,412 | 6/1902 | Dopheide | 215/355 |
| 2,101,324 | 12/1937 | Warner | 215/355 |
| 3,330,281 | 7/1967 | Visser | 215/247 |
| 3,934,746 | 1/1976 | Linja | 215/247 |
| 3,958,572 | 5/1976 | Lawhead | 215/247 |
| 3,974,930 | 8/1976 | Gizard | 215/247 |

FOREIGN PATENT DOCUMENTS

| | | | |
|---|---|---|---|
| 693656 | 7/1953 | United Kingdom | 215/355 |

*Primary Examiner*—George T. Hall

*Attorney, Agent, or Firm*—Dressler, Goldsmith, Shore, Sutker & Milnamow, Ltd.

[57] ABSTRACT

A stopper is provided which is adapted to be held in place in an opening in a molded thermoplastic container that is molded about the stopper in place. The stopper has a substantially cylindrical body portion with a planar end surface at one end thereof and a unitary skirt portion depending from the other end of the body portion. An annular flange, unitary with the body portion, extends laterally away from the body portion in one end thereof to define first and second peripheral flange surfaces and a lateral flange surface. The first peripheral flange surface is contiguous with the planar end surface and with the lateral flange surface. The first peripheral flange surface further is disposed at an angle with respect to the planar end surface and converges towards the second peripheral flange surface in a direction away from the body portion. The second peripheral flange surface is contiguous with the lateral flange surface and the skirt portion.

15 Claims, 8 Drawing Figures

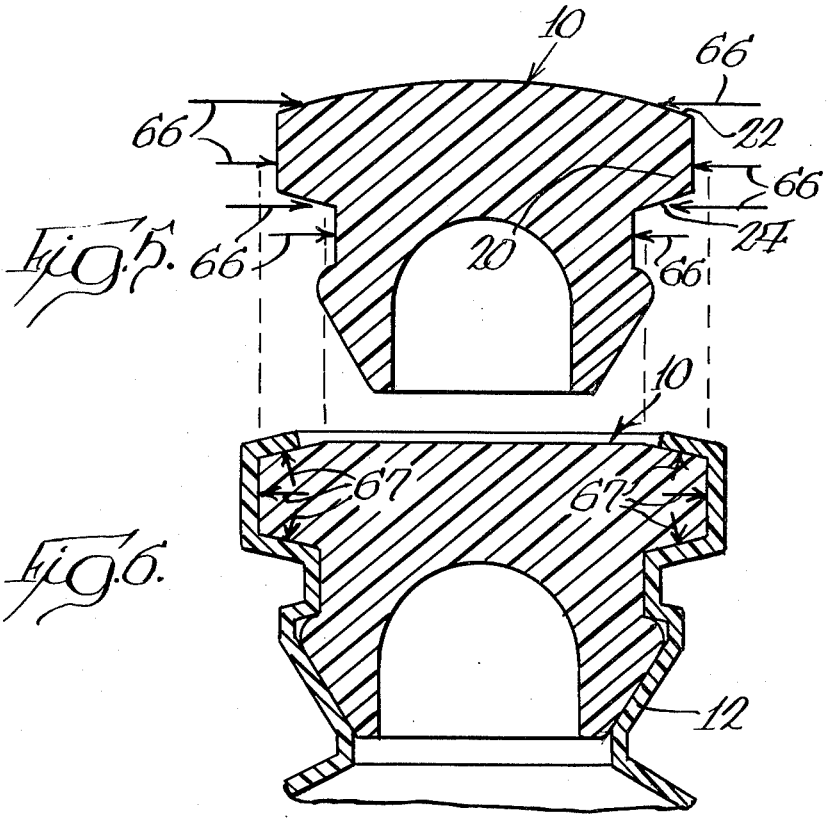
Fig. 5.
Fig. 6.
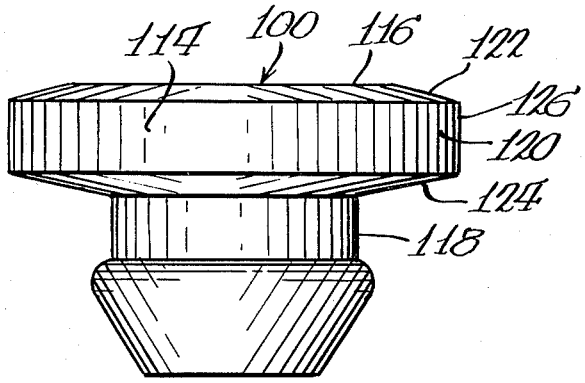
Fig. 7.
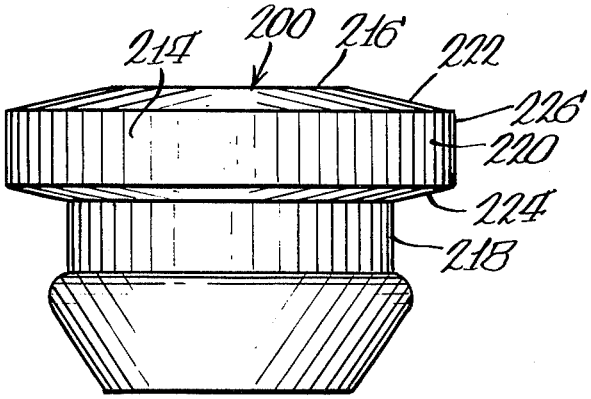
Fig. 8.

STOPPER

BACKGROUND OF THE INVENTION

The present invention relates to an improvement in elastic stoppers for thermoplastic containers, and in particular, for plastic stoppers around which thermoplastic container neck portions can be molded.

Elastic stoppers for containers are, of course, known. Typically, such stoppers comprise a cap having an upper portion which is disc-shaped and a lower portion in the form of a downwardly depending skirt which extends into the neck of the container. These stoppers are used in glass containers in conjunction with an aluminum overcap, or the like, to retain the stopper within the container.

However, when such stoppers are used in conjunction with thermoplastic containers that are molded thereabout by conventional blow molding techniques, or otherwise, it has been found that a satisfactory seal between the container and the stopper is not always formed. Using such techniques the stopper is positioned within the mold cavity the parison is extruded about the stopper, and the mold is closed thereabout. The parison is then blown to form the container and is squeezed about the stopper in the neck portion. However, owing to the compression of the stopper during the molding process the stopper is deformed and bulges outwardly a slight amount and the parison necessarily conforms to the bulged-out contour of the stopper during the molding process. When the mold halves are removed, the pressure on the resilient stopper is relieved and the stopper substantially returns to its original shape. This causes portions of the stopper to pull away from the wall of the container neck molded thereabout and can result in a defective seal about the stopper.

The above-described sealing problem is especially severe in molded, thermoplastic containers having a very small neck portion and, consequently, require a very small stopper. The problem is particularly acute with stoppers having an outside diameter of about one-half inch or less, and in particular, with stoppers having an outside diameter of less than about 0.4 inch.

It would be desirable to provide a small stopper of the type and size discussed above with a configuration which would permit a container to be molded about the stopper in place to form an effective seal between the stopper and the container.

SUMMARY OF THE INVENTION

The present invention contemplates a resilient stopper well suited for use with molded thermoplastic containers.

The stopper includes a generally cylindrical lower portion of resilient material and an upper cap portion of specific configuration. The cap portion is unitary with the lower portion, and is made of the same material as the lower portion. The upper cap portion is of a diameter that is greater than the outside diameter of the lower portion and projects outwardly from the periphery of the lower portion to define an annular flange thereabove. The flange has a generally cylindrical side surface substantially coaxial with the longitudinal axis of the side surface of the cylindrical lower portion and of the stopper. The cap portion further defines a generally circular central top surface centered about the longitudinal axis of the stopper and an outwardly beveled peripheral upper surface between the circular central top surface and the cylindrical side surface of the flange. In other words, the peripheral upper surface is increasingly spaced from a reference plane located above the stopper perpendicular to the longitudinal axis of the stopper with increasing radial distance from this longitudinal axis. Preferably, the peripheral upper surface is a generally frustoconical surface.

For optimum sealing it is preferable that the flange also defines a beveled peripheral lower surface extending between the exterior of the cylindrical lower portion and the cylindrical side surface of the flange. The peripheral lower surface is generally oppositely facing from the peripheral upper surface and is decreasingly spaced from the aforementioned reference plane with increasing radial distance from the longitudinal axis.

With the above-described preferred novel stopper structure, all of the surfaces of the stopper which are ultimately in contact with the molded wall of the container have a vertical component. That is, all of these surfaces can be projected to a vertical plane which is parallel to the longitudinal axis of the stopper. This permits a mold half, with mating surfaces, to be moved in one direction, perpendicular to the longitudinal axis of the stopper, and to contact the stopper surfaces and to thereby compress all of the stopper surfaces by movement of the mold in one direction. Thus, during molding of the container, the container neck wall will be forced against all contiguous surfaces of the stopper. When the mold is opened, the subsequent tendency of the stopper to expand outwardly against the container wall molded thereabout will occur at all stopper/container wall surfaces and a tight seal will be effected.

Thus, it is seen that the combined effect of the various elements of the novel structure of the stopper of the present invention is greater than the sum of the several effects of those elements taken separately. The novel combination of elements in accordance with the present invention yields desirable, beneficial and synergistic results—results which are a substantial improvement over the prior art. Moreover, the present stoppers, when used in molded thermoplastic, obviate the need for a retaining overcap of the type necessary for use with elastic stoppers in glass containers; however, such an overcap may be used, if desired, as a dust cover or tamperproof seal.

Numerous other advantages and features of the present invention will become readily apparent from the following detailed description of the invention and of one embodiment thereof, from the claims and from the accompanying drawings.

BRIEF DESCRIPTION OF THE DRAWINGS

In the accompanying drawings forming part of the specification, and in which like numerals are employed to designate like parts throughout the same.

FIG. 5 is a cross-sectional view of the stopper of the present invention diagrammatically showing the forces being applied to the stopper during container molding;

FIG. 6 is a fragmentary cross-sectional view of the stopper of the present invention with a container having been molded in place thereabout and after the mold has been removed permitting the stopper to expand against the container neck walls;

FIG. 7 is a side elevation view of a further embodiment of the stopper of the present invention; and FIG. 8 is a side elevation view of yet another embodiment of the stopper of the present invention.

DESCRIPTION OF THE PREFERRED EMBODIMENT

Figure 1:
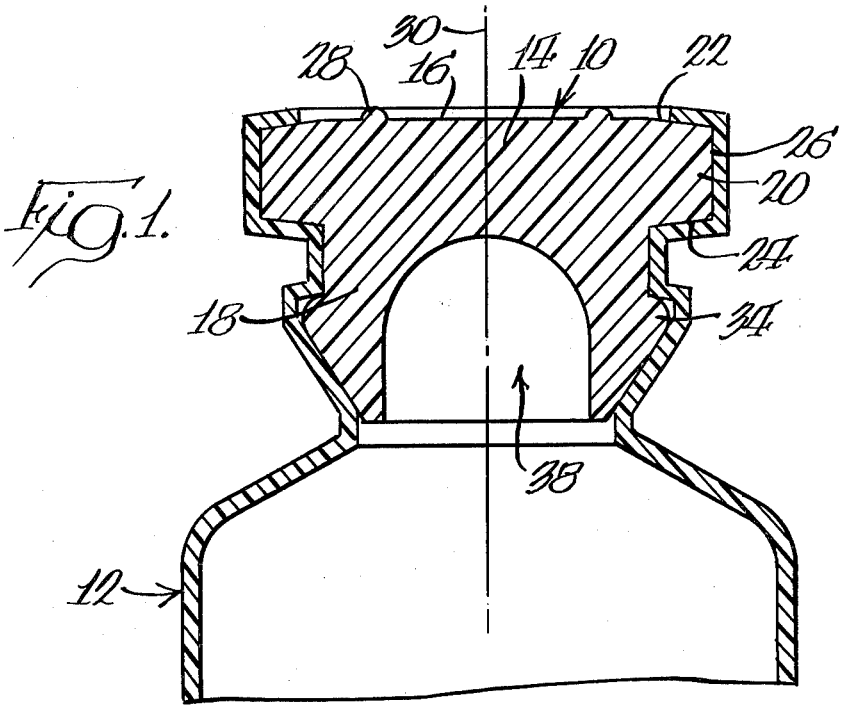
FIG. 1 is a fragmentary cross-sectional view of a molded container with a stopper embodying the present invention positioned in place in the neck of the container molded thereabout.

While this invention is susceptible of embodiment in many different forms, there are shown in the drawings and will herein be described in detail preferred embodiments of the invention. It should be understood, however, that the present disclosure is to be considered as an exemplification of the principles of the invention and is not intended to limit the invention to the embodiments illustrated.

Figure 2:
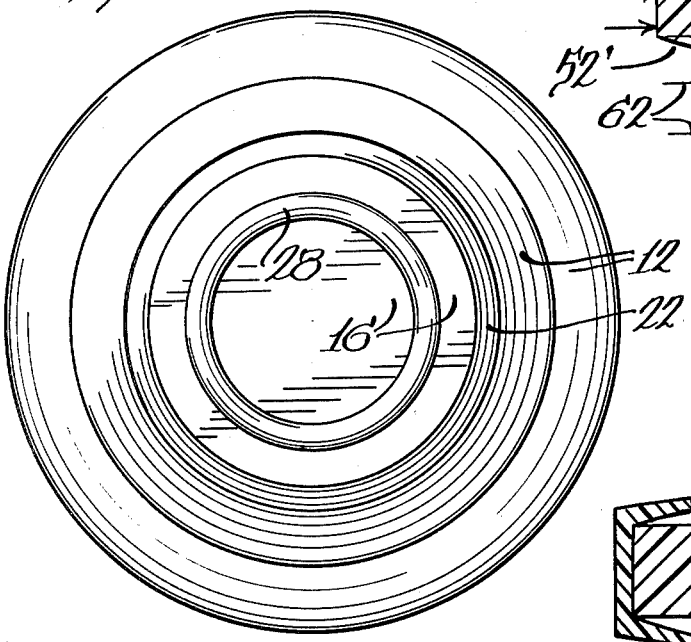
FIG. 2 is a top view of the stopper and container shown in FIG. 1.

Referring to the drawings, and particularly to FIGS. 1 and 2 there is illustrated a stopper 10 within the neck of a thermoplastic container 12 which has been molded thereabout. The stopper 10 has a generally circular configuration and is made of an elastic or resilient material such as rubber or other suitable synthetic material.

The stopper has a substantially cylindrical upper cap portion or body portion 14 having a planar end surface 16 at one end thereof and a unitary cylindrical lower portion or skirt portion 18 depending from the other end of the body portion 14. The stopper can be said to be symmetric about longitudinal axis 30 of stopper 10. If desired, an annular protuberance 28, circumscribing a pierceable region of the stopper, may project from the planar end surface 16.

An annular flange 20, unitary with the body portion 14, extends laterally away from the body portion 14 and defines a first or upper peripheral flange surface 22, a second or lower peripheral flange surface 24, and a lateral flange surface 26.

The first peripheral flange surface 22 is contiguous with the planar end surface 16 and with the lateral flange surface 26. The first peripheral flange surface 22 is outwardly beveled, i.e., surface 22 lies at an angle with respect to the planar end surface 16 and converges toward the second peripheral flange surface 24 with increasing distance away from the body portion 14. The second peripheral flange surface 24 is contiguous with the lateral flange surface 26 and the skirt portion 18, and also preferably converges toward the first peripheral flange surface 22 with increasing distance from said body portion 14.

With respect to an imaginary reference plane defined as lying above the planar end surface 16 and as being perpendicular to the longitudinal axis 30, flange surface 22 can be characterized as being increasingly spaced from the plane with increasing radial distance from the axis while flange surface 24 is either uniformly or decreasingly spaced from the plane with increasing radial distance from the axis, as desired.

Preferably, both the first peripheral flange surface 22 and the second peripheral flange surface 24 are planar surfaces which are angled or outwardly beveled with respect to the above defined reference plane so as to generally define frustoconical surfaces with respect to the axis 30.

The planar end surface 16 is a generally circular central top surface which preferably lies substantially in a plane perpendicular to the longitudinal axis 30.

The skirt or lower portion 18 of the stopper preferably can be provided with a circumferential convex protuberance means or bulge 34 for being compressively engaged by the walls forming the opening or neck of the container 12. Also, for a pierceable stopper preferably the skirt 18 defines a concave chamber 38 opening to the exterior of the skirt in a direction away from the upper cap portion 14.

The above-described novel structure of the present invention allows the stopper 10 to be placed in a mold cavity so that the container 12 can be blow-molded in place about the stopper 10 with a formation of a generally tight and effective seal between the walls of the container 12 and the exterior surfaces of the stopper 10, particularly when using relatively small stoppers. The stopper of the present invention is a significant improvement over the stoppers of the prior art with which it is difficult if not impossible to form effective seals while a container is blow-molded in place about the stopper.

Figure 3:
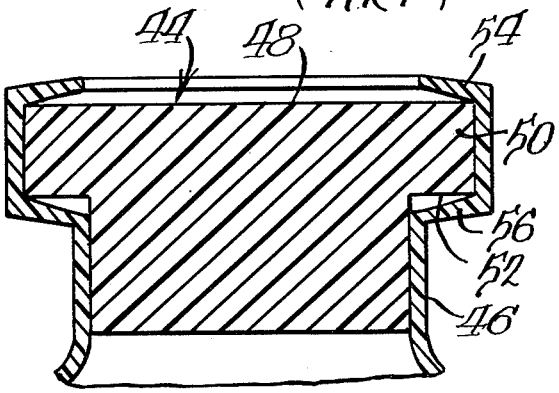
Fig. 3. (PRIOR ART)
FIG. 3 is a fragmentary cross-sectional view of a typical prior art stopper and a container diagrammatically showing compression of the stopper during molding of the container thereabout.

The problem encountered when using typical prior art stoppers is illustrated in FIG. 3 wherein a container 46 is shown as having been molded about conventional stopper 44. The stopper has a generally flat or planar top surface 48 with a projecting flange 50. The underside of the flange 50 has a generally flat lower surface 52 which is generally parallel to the plane of the upper surface 48. As can be seen from FIG. 3, container wall portions 54 and 56 are displaced outwardly and away from the upper surface 48 and lower surface 52 of the stopper, respectively. As a result, wall portions 54 and 56 are not in intimate contact with the adjacent stopper surfaces. Obviously, the lack of intimate, surface-to-surface contact between these portions of the container and the stopper contributes to a poor seal between the stopper and the container.

Figure 4:
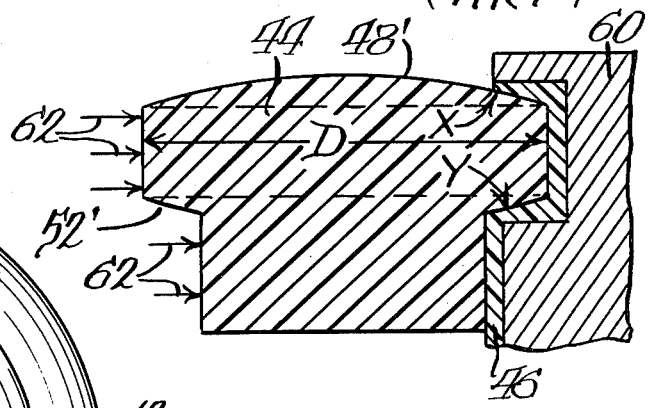
Fig. 4. (PRIOR ART)
FIG. 4 is a fragmentary cross-sectional view of a typical prior art stopper and a container molded thereabout.

It is believed that a principal reason for the poor seal between the prior art stopper 44 and the container 46 illustrated in FIG. 3, and described above, is the shape of the stopper. By way of explanation, FIG. 4 schematically illustrates the molding of a container 46 around the prior art stopper 44. The stopper 44 is initially positioned, between relatively movable mold halves, such as mold half 60, in the mold cavity forming the neck of the container. A parison is then extruded about the stopper in a manner known in the art the mold halves are closed about the parison. In FIG. 4, only the right half of the mold 60 is illustrated as abutting the parison portion which forms the container wall 46.

On the left side of the stopper in FIG. 4, arrows 62 schematically show the direction of forces applied to the stopper 44 during container molding. Owing to these compressive forces on the resilient stopper 44, the stopper bulges outwardly as indicated by convex crown 48' and the bulging lower flange surface 52'.

When the mold halves are opened after the intended container has been formed, the compressive force on the stopper 44 is substantially reduced and, owing to the resilient nature of the stopper, the stopper tends to return to its original configuration by expanding outwardly along its greatest diameter D. This tendency pulls the crown 48' and the flange lower surface 52' inwardly back to the substantially flat and mutually parallel configuration illustrated in FIG. 3. As a result, the confronting container wall portions 54 and 56 become spaced outwardly a slight amount from the now retracted stopper surfaces as illustrated in FIG. 3.

Further, as best illustrated in FIG. 4, owing to the fact that the mold halves usually are moved generally perpendicular to the longitudinal axis of the stopper 44, the force exerted on the upper and lower surfaces of the flange 50 is generally minimal (which is why these surfaces bulge outwardly). Thus, undesirable thickness variations in the wall of the container 46 can occur between the bulging surface of the stopper and the surface of the mold (designated by X and Y in FIG. 4).

The novel structure of the stopper of the present invention overcomes the above-described difficulties in molding a container about the stopper. This is best illustrated with reference to FIGS. 5 and 6 wherein the stopper 10 of the present invention is illustrated first, in FIG. 5, as being compressed (as by forces generated during the molding process by the molds) and second, in FIG. 6, as being free to expand against the walls of the container 12 after the mold halves have been removed.

Owing to the angled configuration of the first and second peripheral flange surfaces 22 and 24 respectively, the mold necessarily exerts pressure upon those surfaces when the mold is moved in a direction perpendicular to the longitudinal axis of the stopper during the molding process. Consequently, as illustrated by the vectors 66, all surfaces of the flange 20 are squeezed inwardly by the mold. Thus, the stopper 10 cannot bulge outwardly in the area of the flange. Consequently, as illustrated in FIG. 6, when the mold is opened, the stopper 10 expands, as shown by arrows 67, not only along its greatest diameter, but also upwardly and downwardly to move both the first and second peripheral surfaces upwardly and downwardly, respectively, against the wall of the container 12, thus ensuring a tight fit and good seal between the stopper 10 and container 12.

FIGS. 7 and 8 illustrate additional embodiments of the stopper of the present invention designated by numerals 100 and 200, respectively. Each stopper 100 and 200 has a generally cylindrical lower portion 118 and 218, respectively. An upper cap or body portion 114 and 214, respectively, of resilient material unitary or integral with the lower portion at one end thereof projects outwardly from the periphery of the lower portion to define an annular flange, 120 and 220, respectively. The flange has a generally cylindrical side surface, 126 and 226, respectively, coaxial with the longitudinal axis of the cylindrical lower portion.

The cap portion of each stopper defines a generally circular central top surface 116 and 216, respectively, centered about the longitudinal axis of the stopper. The cap portion of each stopper further defines a beveled peripheral upper surface 122 and 222, respectively, between the circular central top surface and the cylindrical side surface of the flange. The peripheral upper surface is increasingly spaced from a reference plane located above the stopper perpendicular to the longitudinal axis of the stopper.

Also, the stoppers preferably have a beveled peripheral lower surface 124 and 224, respectively, extending between the exterior of the cylindrical lower portion and the cylindrical side surface of the flange. The peripheral lower surface 126 and 226, respectively, is generally oppositely facing from the peripheral upper surface and is decreasingly spaced from the reference plane with increasing radial distance from the longitudinal axis.

As can be seen in FIGS. 7 and 8, the diameter of the generally circular central top surface 100 or 200 relative to the outside diameter of the stopper flange can be varied. In FIG. 7, the stopper 100 has a central top surface 116 which has a diameter greater than the cylindrical lower portion 118 so that the frustoconical peripheral upper surface 122 has an inner diameter which is greater than that of the frustoconical peripheral lower surface 124.

On the other hand, the stopper 200 in FIG. 8 has a circular central top surface 216 which has a diameter less than the diameter of the cylindrical lower portion 218. Consequently, the inside diameter of the frustoconical peripheral upper surface 222 is less than the inner diameter of the frustoconical peripheral lower surface 224.

Though not illustrated in FIGS. 7 and 8, the generally circular central top surface (such as surface 116 on the stopper 100 illustrated in FIG. 7) may have an annular protuberance similar to protuberance 28 in FIG. 1. Also, the central top surface need not have any flat regions, but may be entirely convex or concave if desired. However, for most purposes, a generally flat surface appears to be desirable at this time.

To the extent that a tight seal is not necessarily required, for a given application, on the bottom of the flange (e.g., flange 20 for the stopper 10 illustrated in FIG. 1), the peripheral lower flange surface 24 may be formed, lying substantially in a plane perpendicular to the longitudinal axis of the stopper. For example, with the stopper 10 illustrated in FIG. 1, if the second or lower peripheral flange surface 24 lay in one plane generally perpendicular to the longitudinal axis 30 of the stopper, the slanted configuration of the first or upper peripheral flange surface 22 would still maintain the wall of the container 12 tight against the top of the stopper 10.

With the stopper of the type of the present invention having an outer flange diameter of about 0.395 inch (10.0 mm), it has been found that when a container is molded about the stopper in place, an effective seal is formed between the wall of the container and the stopper if at least the peripheral upper surface converges toward the peripheral lower surface with increasing radial distance from the center of the stopper and more particularly, if the peripheral upper surface is a generally frustoconical surface and defines an included angle of no more than 88 degrees with respect to the longitudinal axis of the stopper. Preferably, the angle should be no more than 85 degrees, though satisfactory results have been obtained with the angle lying between 88 and 80 degrees.

It is preferred that the peripheral lower surface be generally frustoconical and that the peripheral lower surface define an included angle of about 85 degrees with the longitudinal axis.

Preferably, and in particular with relatively small stoppers (0.4 inch in diameter, or less) contemplated by the present invention, the ratio of the exterior diameter of the flange or upper cap portion to the thickness of the flange at the juncture of the flange and the lower or skirt portion should be less than about 5. Further, the ratio of the exterior diameter of the flange to the exterior diameter of the lower portion at the juncture of the flange and the lower portion should be less than about 1.5. The peripheral lower surface of the flange can be joined to the cylindrical side surface of the flange with the radius of curvature of about 0.025 inch.

From the foregoing, it will be observed that numerous variations and modifications may be effected without departing from the true spirit and scope of the novel concept of the invention. It is to be understood that no limitation with respect to the specific apparatus illustrated herein is intended or should be inferred. It is, of course, intended to cover by the appended claims all such modifications as fall within the scope of the claims.

What is claimed is:

1. A stopper adapted to be held in place in an opening in a molded thermoplastic container which is molded about the stopper in place, said stopper comprising:

a generally cylindrical lower portion having a longitudinal axis;

a generally cylindrical upper cap portion of resilient material integral with said lower portion at one end thereof, coaxial therewith, and projecting outwardly from the periphery of said lower portion to define an annular flange thereabove, said flange having a generally cylindrical side surface substantially coaxial with said longitudinal axis;

said cap portion defining a generally circular central top surface centered about said longitudinal axis and further defining an outwardly beveled peripheral upper surface between said circular central top surface and said cylindrical side surface of said flange; and the ratio of the exterior diameter of said flange to the thickness of said flange at the juncture of said flange and said lower portion being less than about 5.

2. The stopper in accordance with claim 1 in which said peripheral upper surface is a generally frustoconical surface.

3. The stopper in accordance with claim 2 in which said peripheral upper surface defines an included angle of no more than about 88 degrees with respect to said longitudinal axis.

4. The stopper in accordance with claim 3 in which said peripheral upper frustoconical surface defines an angle of no more than about 85 degrees with respect to said longitudinal axis.

5. The stopper in accordance with claim 2 in which said peripheral upper frustoconical surface defines an angle of about 88 to about 80 degrees with respect to said longitudinal axis.

6. The stopper in accordance with claim 1 in which the lateral surface of said lower portion is provided with a circumferential convex protuberance means for being compressively engaged by the walls forming the opening of said container.

7. The stopper in accordance with claim 1 in which said flange presents an outwardly beveled peripheral lower surface extending between the exterior of said cylindrical lower portion and said cylindrical side surface of said flange, said peripheral lower surface being generally oppositely facing from said peripheral upper surface and converging toward said peripheral upper surface with increasing radial distance from the longitudinal axis.

8. The stopper in accordance with claim 7 in which said peripheral lower surface is generally frustoconical.

9. The stopper in accordance with claim 8 in which said peripheral surface defines an included angle of about 85 degrees with said longitudinal axis.

10. The stopper in accordance with claim 1 in which the ratio of the exterior diameter of said flange to the exterior diameter of said lower portion at the juncture of said flange and said lower portion is less than about 1.5.

11. The stopper in accordance with claim 1 in which said flange defines a peripheral lower surface facing generally away from said circular central top surface and joined to said cylindrical side surface of said flange with a radius of curvature of about 0.025 inch.

12. The stopper in accordance with claim 1 in which said lower portion defines a concave chamber opening to the exterior of said lower portion in a direction away from said upper cap portion.

13. The stopper in accordance with claim 1 in which said generally circular central top surface lies substantially in a plane perpendicular to the longitudinal axis.

14. A stopper adapted to be held in place in an opening in a molded thermoplastic container which is molded about the stopper in place, said stopper comprising:

a substantially cylindrical body portion having a planar end surface at one end thereof and a unitary skirt portion depending from the other end of said body portion;

an annular flange, unitary with said body portion, extending laterally away from said body portion, and defining first and second peripheral flange surfaces and a lateral flange surface; and said first peripheral flange surface being contiguous with said planar end surface and with said lateral flange surface, said first peripheral flange surface being disposed at an angle with respect to said planar end surface and converging toward said second peripheral flange surface in a direction away from said body portion, and said second peripheral flange surface being contiguous with said lateral flange surface and said skirt portion.

15. The stopper in accordance with claim 14 in which said first and second peripheral flange surfaces are each generally frustoconical and converge with increasing radial distance from the longitudinal axis of said annular flange.

* * * * *